US007736196B1

(12) United States Patent
Isaac et al.

(10) Patent No.: US 7,736,196 B1
(45) Date of Patent: Jun. 15, 2010

(54) RUGGED, POLARIZED CONNECTOR AND ADAPTOR

(75) Inventors: Emad S. Isaac, Downers Grove, IL (US); Daniel A. Sanchez, Round Lake Beach, IL (US)

(73) Assignee: The Morey Corporation, Woodridge, IL (US)

( * ) Notice: Subject to any disclaimer, the term of this patent is extended or adjusted under 35 U.S.C. 154(b) by 0 days.

(21) Appl. No.: 12/324,156

(22) Filed: Nov. 26, 2008

(51) Int. Cl.
*H01R 13/64* (2006.01)

(52) U.S. Cl. ..... 439/680; 439/247

(58) Field of Classification Search ..... 439/677, 439/680, 681, 247, 248
See application file for complete search history.

(56) References Cited

U.S. PATENT DOCUMENTS

| | | | | |
|---|---|---|---|---|
| 2,906,986 | A | 9/1959 | Schaefer | |
| 3,136,592 | A | 6/1964 | Miller | |
| 3,194,588 | A | 7/1965 | Buckey et al. | |
| 3,551,880 | A * | 12/1970 | Hartwell | 439/314 |
| 4,059,324 | A * | 11/1977 | Snyder et al. | 439/321 |
| 4,111,514 | A * | 9/1978 | Brishka et al. | 439/680 |
| 4,211,461 | A * | 7/1980 | Wescott | 439/357 |
| 4,349,241 | A * | 9/1982 | Juris et al. | 439/88 |
| 4,423,919 | A | 1/1984 | Hillis | |
| 4,736,999 | A * | 4/1988 | Marks et al. | 439/314 |
| 5,641,310 | A * | 6/1997 | Tiberio, Jr. | 439/680 |
| 6,416,334 | B1 * | 7/2002 | Plishner | 439/75 |
| 6,431,915 | B1 | 8/2002 | Ko | |
| 6,450,834 | B1 * | 9/2002 | Polgar et al. | 439/546 |
| 7,029,323 | B1 | 4/2006 | Petersen et al. | |
| 7,175,622 | B2 * | 2/2007 | Farris | 606/250 |
| 7,285,003 | B2 | 10/2007 | Cairns et al. | |
| 7,326,091 | B2 | 2/2008 | Nania et al. | |
| 7,353,089 | B1 | 4/2008 | McEvoy | |
| 7,435,123 | B2 * | 10/2008 | Franks, Jr. | 439/271 |
| 2005/0164562 | A1 | 7/2005 | Lee et al. | |

FOREIGN PATENT DOCUMENTS

| | | |
|---|---|---|
| JP | 2002-56936 A | 2/2002 |

* cited by examiner

*Primary Examiner*—Thanh-Tam T Le
(74) *Attorney, Agent, or Firm*—Vedder Price P.C.; Angelo J. Bufalino

(57) ABSTRACT

This disclosure relates to a rugged, polarized connector or adaptor with interlocking end tabs and notches for polarizing a jack to a specific plug, and in one specific embodiment, a QMA-type RF connector where a rugged spanner nut and a rugged jack casing are used to reinforce the mating connector ends. The connector also includes tabs and mating notches on the spanner nut and the jack casing to polarize the connectors without creating a weakness in the rugged connection. A series of tab orientations is illustrated, a method for grounding the spanner nut to the connector, and a method of using the rugged and polarized interface on any type of connector or as part of a connector adaptor or add-on.

14 Claims, 7 Drawing Sheets

RUGGED, POLARIZED CONNECTOR AND ADAPTOR

FIELD OF THE DISCLOSURE

This disclosure relates to a rugged, polarized connector or adaptor with interlocking end tabs and notches for mating a jack to a plug, and more particularly, to a QMA-type RF connector with a rugged, polarized spanner nut mounted on a plug with notches for mating to tabs on a rugged jack.

BACKGROUND

Electrical connectors are conductive bridges that join portions of electrical circuits. Some connectors are temporary bridges and are interfaces between different elements in a system, such as connectors on a rear panel of electrical components in large systems. Hundreds of types of electrical connectors exist on the market. One familiar type of connector is the quick-fit connector used at both ends of a wire used to either connect a television to a local cable or antenna, the television to a recording device, or a keyboard to a computer. Each of these cables has at both ends a male connector (a plug) and a female connector (a jack) bridged to the cable on which they are mounted.

Because of a need for the electrical equipment designed by a wide range of providers to interface properly with other devices designed by different firms, connectors at their interfaces are often forced to meet agreed-upon technical standards. For example, some of the most common types of connectors include the phone line 8P8C connector, the serial computer connector DE-9, the Universal Serial Bus (USB) connector for the connection of memory cards to most computers, and Radio Frequency (RF) connectors such as the cable connector designed to main impedance in the line. Any rugged, polarized connector improvement must not interfere with the capacity of the connector to meet technical standards.

RF connectors are electrical connectors designed to work at radio frequencies in the multimegahertz range. RF connectors are typically used on coaxial cables and are designed to maintain constant shielding over the length of the connector. Mechanical fasteners made of mating male and female ends are often called the plug and the jack. At the ends, or interfaces, threads, bayonets, braces, pull-push, springs, or any other locking mechanism is used to hold the plug to the jack so the coaxial cable of the RF connector is electrically connected.

For example, wireless transceivers operate mostly in electrical systems using RF connectors. Many different types of RF connectors have been created over the years, such as, for example, standard connectors (7/16 DIN, BNC, C, Dezifix, F, HN, IEC 169-2, LC, Motorola, Musa, NMO, N, SC, TNC, UHR), miniature connectors (M-BNC, M-UHF, DIN 47223, U.FL, and SMZ), subminiature connectors (MMCX, MCX, FME, SMA, SMB, SMC, and SMP), precision connectors (APC-7), flange connectors (EIA RF), and even quick-lock connectors (QMA, QLS, SnapN, and CQMA).

As an improvement to threaded RF connectors, such as the SMA connector with ring on the jack that is rotated clockwise over the threads on a plug for coupling, snap-on connectors such as the QMA connectors are improved types of SMA connectors where the jack in pushed against a face of the plug and small radial legs are bent out until they clip back in a groove that is off-set from the face of the connector. To release the QMA connector, the user must move an external ring on the connector until the radial legs are bent out to release the groove.

These connectors, when mounted on a RF coaxial cable, have radial symmetry (i.e., the jack does not need to be specifically oriented). Only connectors mounted on cables with a multitude of conductors lose part of this radial symmetry. Standardized connectors, aside from the power category of electrical connectors, are not polarized; any plug can be mounted on any jack as long as the radius of the connectors are the same. A connector with four internal conductors where each conductor is arranged in a square configuration, each located on the outer corners of the configuration, remove all but four angles of radial symmetry to the connector (i.e., the jack can be oriented at four different orientations compared to the mated plug). Even when a portion of the radial symmetry is compromised, any standardized jack can still be mounted on any standardized plug.

RCA connectors, or audio/video connectors used to connect components to a monitor, uses a color code (yellow is video, white and red are audio) to distinguish between the nonpolarized cables. One obvious problem associated with this polarization technology is the need to view colors and have visual access to all plugs often located in hard-to-reach areas. In addition, even when visual access is possible, human error is still possible. In cases when equipment is damaged if the conductors are misconnected, or when it is difficult to gain access to the connectors to change the connections, what is needed is a system that is polarized and free of inherent problems associated with visual polarization.

One other possible solution is shown in FIGS. 1A-1B where a threaded jack is equipped with an external ring having longitudinal slots on the external surface of the ring. A second ring is mounted on the plug and has a series of angled tabs (shown as three tabs at 120°) that slide into the longitudinal slots as the connector is screwed in. This device does not teach displacing the different slots at different angles to polarize the connectors. The system uses tabs interlock the rugged components of the described connector. This system can be mounted only on threaded connectors, not snap-in connectors. This technology cannot be used without aid. With time and fatigue, the angled tabs of the device may be forced in and users can damage the external surface of the jack between the slots as the rings are turned.

What is needed is a simple polarization system for plugs and jacks that can be operated without visual help but instead with a user's manual touch where a very large quantity of polarized configurations can coexist without risk of damaging any element of the connector as the parts wear and fatigue.

Another inherent problem of these connectors is the weakness to shock of both the plug and the jack. The plug generally sticks out from the mounting plate and is of low weight compared to the equipment to which it may be attached. If the equipment to which the jack is mounted is dropped or impacted with the environment, or if a person steps on the plug as it rests on the ground while repairs are conducted, the connector is damaged. As a consequence, equipment designers when possible protect the plugs by placing them in recessed or remote areas of the electrical device on which they are mounted. Recessed plugs are difficult to view and access, compounding the problems associated with visual polarization. Other protection equipment such as bars can be attached to the surrounding structures to protect the plugs. The device shown in FIGS. 1A-B, for example, is not rugged. What is needed is a system capable of protecting the connector within a polarized plug-and-jack environment.

SUMMARY

This disclosure relates to a rugged, polarized connector or adaptor with interlocking end tabs and notches for polarizing a jack to a specific plug, and in one specific embodiment, a QMA-type RF connector where a rugged spanner nut and a rugged jack casing are used to reinforce the mating connector ends. The connector also includes tabs and mating notches on the spanner nut and the jack casing to polarize the connectors without creating a weakness in the rugged connection. A series of tab orientations is illustrated, a method for grounding the spanner nut to the connector, and a method of using the rugged and polarized interface on any type of connector or as part of a connector adaptor or add-on.

BRIEF DESCRIPTION OF THE DRAWINGS

Certain preferred embodiments are shown in the drawings. However, it is understood that the present disclosure is not limited to the arrangements and instrumentality shown in the attached drawings.

DETAILED DESCRIPTION

Figure 1A:
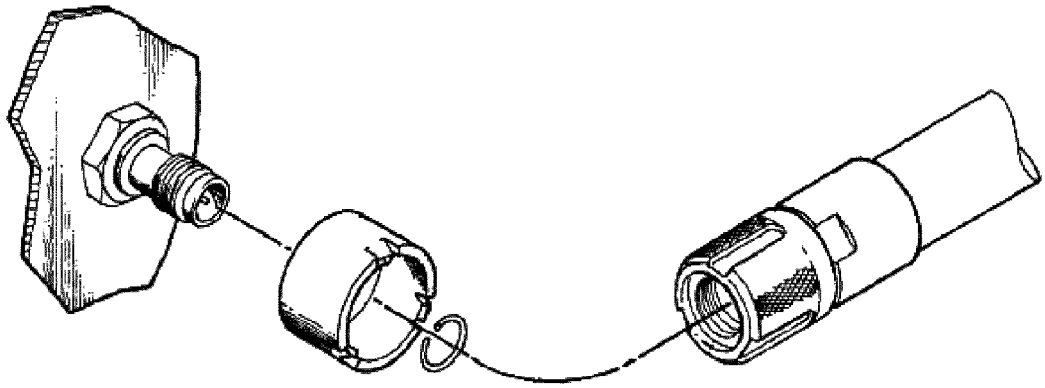
FIG. 1A (Prior Art)
FIG. 1A is an isometric view of a connector from the prior art.
Figure 1B:
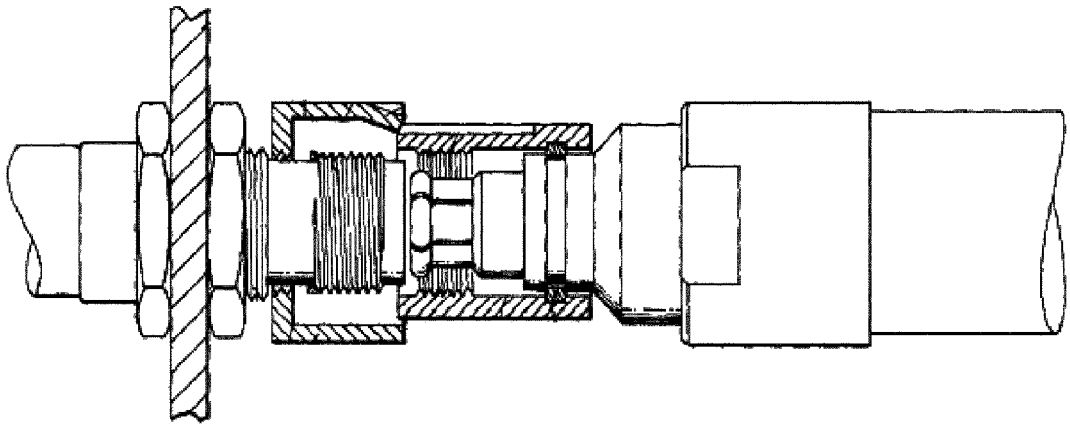
FIG. 1B (Prior Art)
FIG. 1B is a plan view with a cut-out portion of an external connection tool of the connector of FIG. 1A from the prior art.

For the purposes of promoting and understanding the invention and principles disclosed herein, reference is now made to the preferred embodiments illustrated in the drawings, and specific language is used to describe the same. It is nevertheless understood that no limitation of the scope of the invention is thereby intended. Such alterations and further modifications in the illustrated devices and such further applications of the principles disclosed as illustrated herein are contemplated as would normally occur to one skilled in the art to which this disclosure relates.

While this specification describes the novel and inventive concepts used in association with a specific type of RF connector, what is contemplated is the application of these concepts to any type of electrical connector currently known, including those based on existing or contemplated connector standards, or those that stem from periodic technological updates for revised and upgraded communication standards. What is also contemplated is the use of this technology on connectors where the plug and the jack are functionally identical or where an adaptor or plug-in is connected serially to modify a nonrugged, nonpolarized connector. Within this specification the terms "jack" and "plug" are to be construed interchangeably when possible and the described novel technology as shown is to be adapted to either ends of connectors.

Figure 7:
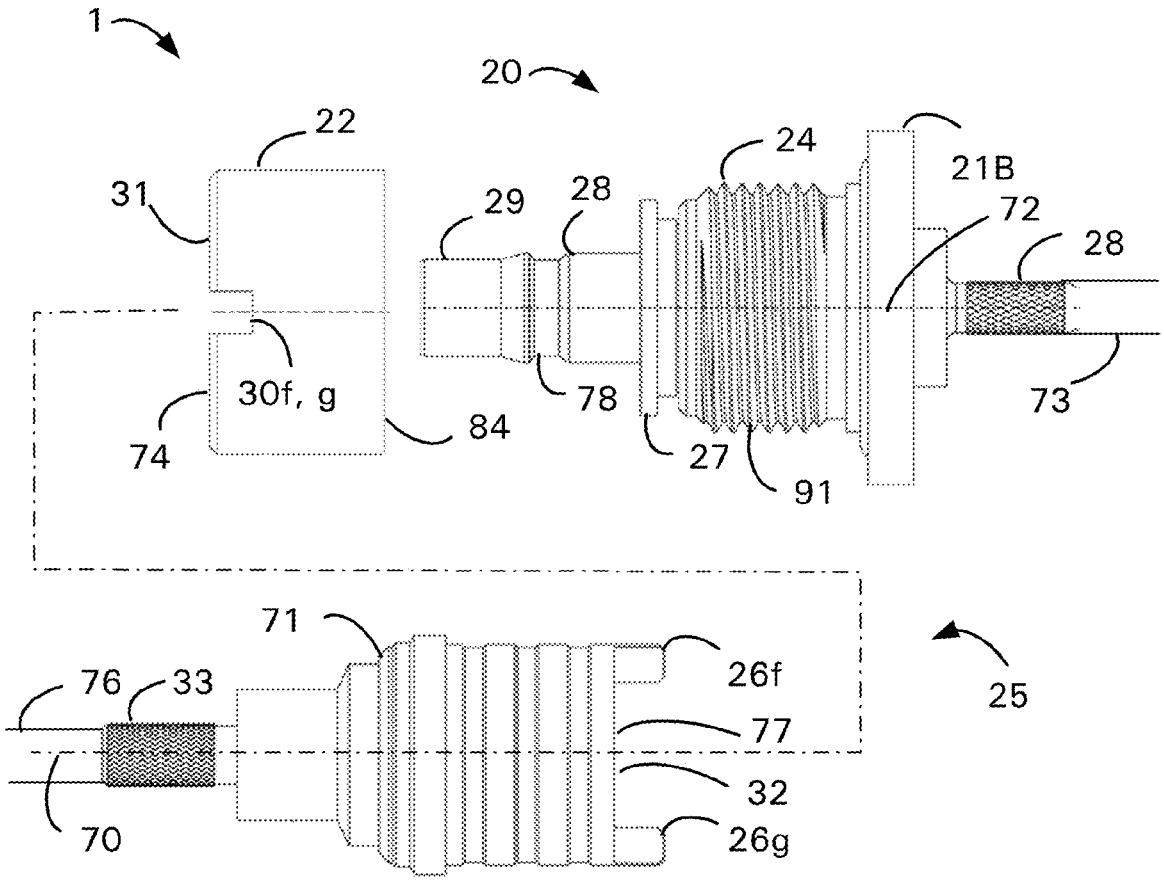
FIG. 7 is a side exploded view of the rugged QMA connector according to an embodiment of the present invention.

A rugged, polarized connector 1 is shown in FIG. 7. The polarized connector 1 is of the QMA type. The connector 1 includes a jack 25 with a principal axis 70 shown as a linear or longitudinal axis for connecting a first cable 76 to a jack interface 77. Some connectors may be bent to any degree based on the environment where they are to be adapted. The connector 1 can have a principal axis 70 in any configuration and orientation, including but not limited to a 90° or a 180° angle as shown in FIG. 7. The jack 25 includes along the principal axis 70 from left to right in FIG. 7 a first cable holder 33 shown by the shaded area to connect the first cable 76 to the first cable holder 33. The first cable 76 can be attached to the first cable holder 33 using any known conventional methods in the art, including, for example, another QMA interface such as heat shrink tubing.

A first casing 71 connected to the first cable holder 33 is shown as a series of rigidified, rugged concentric rings and is connected to the first cable holder 33. The first casing 71 in the embodiment shown is made of a series of radial rings on its outside surface of the casing 71 and bendable locking tabs of the sort generally encountered in QMA connectors to attach to an edge 78 of the plug as shown by numeral element 81 in FIG. 8B. The bendable locking tabs 81 are also moved over the edge by pushing the jack or pushed out through a force made on the first casing 71 to bend the tabs 81 outwards to unlock the connector 1. The figures show a configuration where the first casing 71 acts as the movable part in the snap-on locking system. However, any configuration where the plug is ultimately connected and mated to the jack is contemplated.

The first casing 71 also includes along the principal axis 70 a first end plate 32 shown with a plurality of polarized tabs 26*f* and 26*g*. For the purpose of clarification of the illustrations, in FIGS. 6A, 6B, 7, and 8A where only two tabs are shown, the numbers 26*f* and 26*g* are used for the two tabs, respectively. In FIGS. 5A, 5B, and 8B to 8F where three tabs are shown, the reference numbers 26*a*, 26*b*, and 26*c* are used. While configurations where two and three tabs are shown, what is contemplated is the use of any number of tabs 26 on the end plates of the jack 25, and tabs 26 are to include any projection, angle, our outgrowth from the first end plate 32 that form a jack interface 77 that can be mated on an opposing end plate 74 having a plug interface 31 in mating opposition to interlock with the jack interface 77. The tabs 26 as shown are also large, rugged, and cannot be bent easily. They also mate fully with the spanner nut 22 to create an external connector surface without asperities or openings.

The jack 25 is coupled to a plug 20 having a secondary axis 72 for connecting a second cable 73 to a plug interface 31. As for the principal axis 70, the secondary axis 72 is shown as a longitudinal axis and the plug 20 is shown having the cable 73 aligned with the plug interface 31. In other contemplated embodiments, the secondary axis 72 can be at any orientation.

Figure 2:
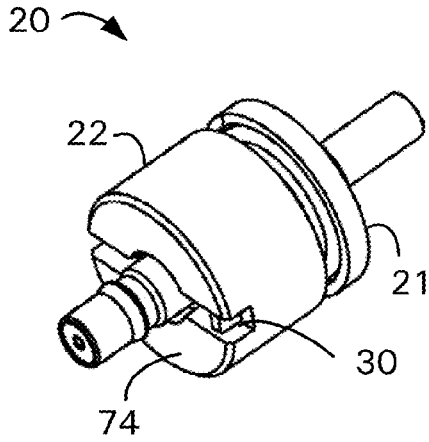
FIG. 2 is an isometric view of a rugged QMA connector jack with spanner nut according to an embodiment of the present invention.
Figure 3:
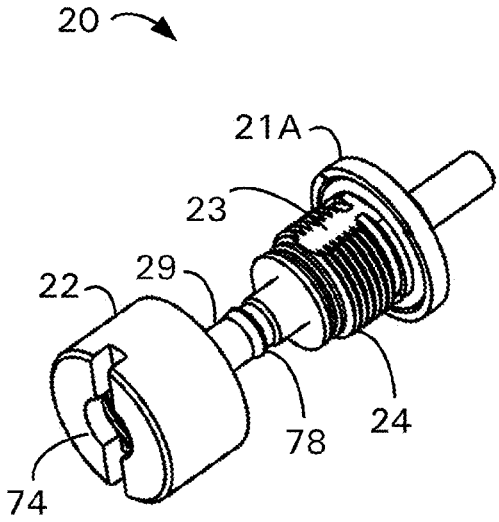
FIG. 3 is an exploded view of the rugged QMA connector jack with spanner nut of FIG. 2 with a flat portion on the threaded portion of the jack according to an embodiment of the present invention.
Figure 4:
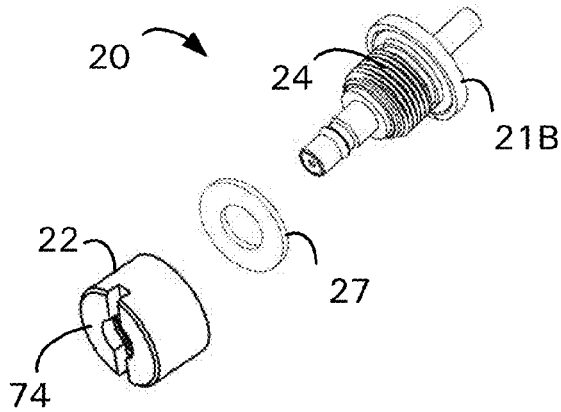
FIG. 4 is an exploded view of the rugged QMA connector jack with spanner nut and seal of FIG. 2 without a flat portion on the threaded portion according to another embodiment of the present invention.
Figure 5A:
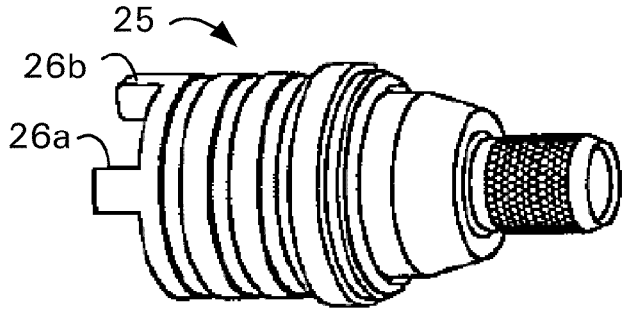
FIG. 5A is an isometric view of a rugged QMA connector plug with end tabs according to another embodiment of the present disclosure.
Figure 5B:
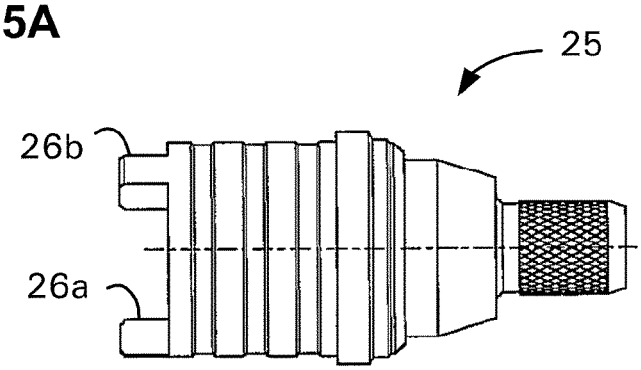
FIG. 5B is a side view of the rugged QMA connector of FIG. 5A with end tabs in a different configuration or orientation according to another embodiment of the present invention.
Figure 6A:
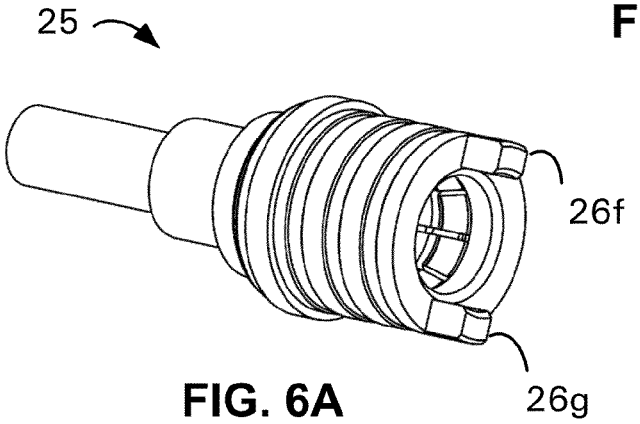
FIG. 6A is an isometric view of a rugged QMA connector plug with end tabs at 180° and 360° according to another embodiment of the present disclosure.
Figure 6B:
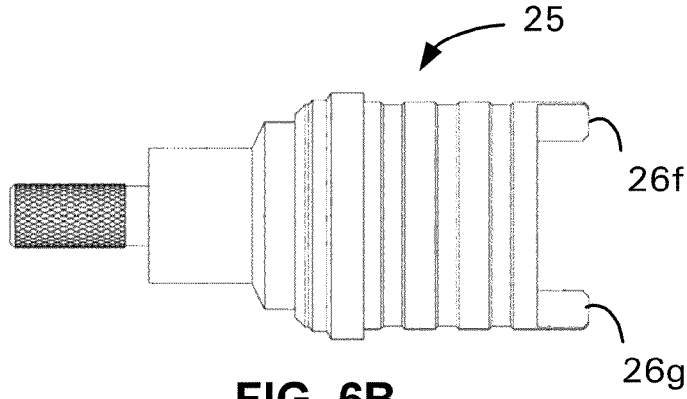
FIG. 6B is a side view of the rugged QMA connector of FIG. 6A.
Figure 9A:
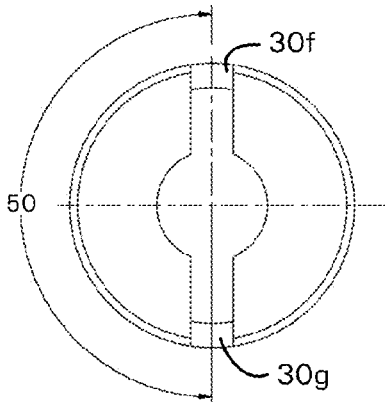
FIGS. 9A to 9F are front views of the end plates of the rugged QMA connector jacks for mating with the rugged QMA connector plugs shown in FIGS. 8A to 8F, respectively.

A second cable holder 28 connects the second cable 73 to a holder 78 to operate the plug 20. A second casing 24 with a second end plate 74 is shown in FIG. 7 with at least two polarized notches 30*f* and 30*g*. Much like the tabs 26 shown with the reference numeral 26 along with indicia letters f and g, the notches are also shown using number 30 with indicia letters f and g. FIGS. 2-4 illustrate a configuration of the plug 20 with two notches on the second end plate 74. FIG. 9A illustrates the second end plate 74 with two notches 30*a* and 30*b*. FIGS. 9B to 9F show the second end plate 74 with three notches 30*a*, 30*b*, and 30*c*.

While configurations with two or three notches are shown, what is contemplated is the use of any number of notches where the term "notch" includes, for example, openings, apertures, lines, shapes, or any other formed structures that can be use to mate the different tabs found on the jack 25. What is described is a plug interface 31 connected to the jack interface 77 for connecting the first cable 76 to the second cable 73 where the first end plate 32 is adjacent to the second end plate 74 and the at least two polarized tabs 26 are mated to the polarized notches 30 as shown in FIG. 7.

By way of nonlimiting example, the first end plate 32 could include a ring with a curved or square profile along the periphery of the first end plate 32 for mating with a second end plate 72 where a grooved ring with either a curved or square profile is made to mate with the formed structure on the first end plate 32.

In one embodiment, the second casing 24 is made of two parts: a threaded portion 91 on a body portion 28 and a spanner nut 22 with an inner thread for mounting the spanner nut 22 on the threaded portion 91. In another embodiment (not shown) the second casing 24 is made of a single part made of both the body portion 28 and the spanner nut 22. The use of a spanner nut 22 with a plug interface 31 and a second end plate 74 with at least two polarized notches 30*f*, 30*g* allows a user to mount on a support surface any plug 20 by removing the spanner nut 22, sliding the second casing 24 through an opening made in a mounting surface or any other place where the plug 20 is to be mounted, and screwing in a mounting plate 21B to lock in the mounting surface. The spanner nut 22 is then screwed back over the body portion 28 over the threaded portion 91 until the mounting surface is fixed tightly between the mounting plate 21B and the inner base 84 of the spanner nut 22. The spanner nut 22 as a separate piece also serves to determine the polarity to be given to polarized connector 1.

As a way of an example, if three identical body portions 28 are mounted to a single mounting surface in three different openings (not shown) and a designer wishes to give different polarities to each of the three cables to be connected via the three polarized connectors 1, then a user selects three external cables where three different jacks 25 with different tabs 26 (polarity). Three different and matching spanner nuts 22 are then mounted on the three connectors 1. Spanner nuts 22 of different polarities are shown in FIGS. 9A to 9F. The angles proposed are only illustrative of possible angle determinations.

While in the preferred embodiment, the polarization is not restricted in angular orientation (i.e., a jack 25 that functions independently of the angular orientation of the jack 25 in the plug 20), the use of tabs and mating notches of different geometry to further distinguish orientations is also contemplated.

Figure 8A:
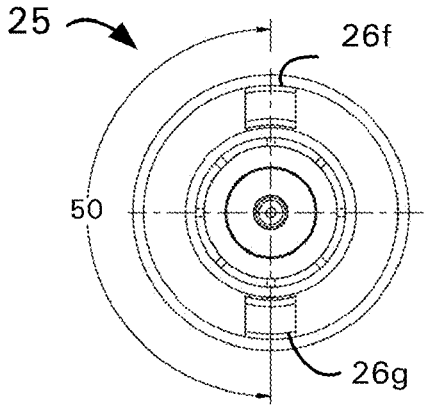
FIG. 8A is a front view of the end plate of the rugged QMA connector plug illustrating tabs oriented at 0° and 180° on the face plate according to an embodiment of the present invention.
Figure 8B:
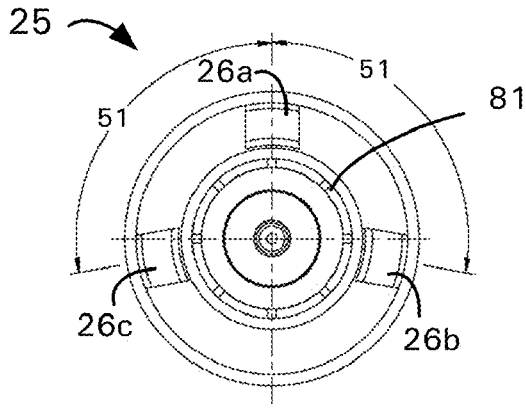
FIG. 8B is a front view of the end plate of the rugged QMA connector plug illustrating tabs oriented at 0°, 100°, and 260° on the face plate according to an embodiment of the present invention.
Figure 8C:
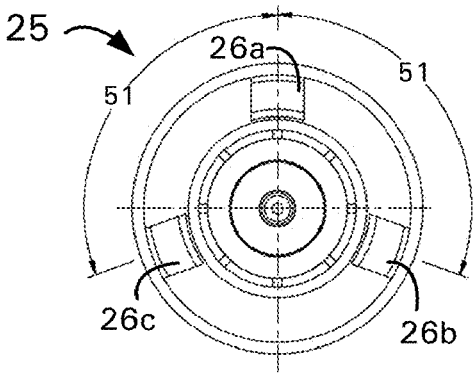
FIG. 8C is a front view of the end plate of the rugged QMA connector plug illustrating tabs oriented at 0°, 110°, and 250° on the face plate according to an embodiment of the present invention.
Figure 8D:
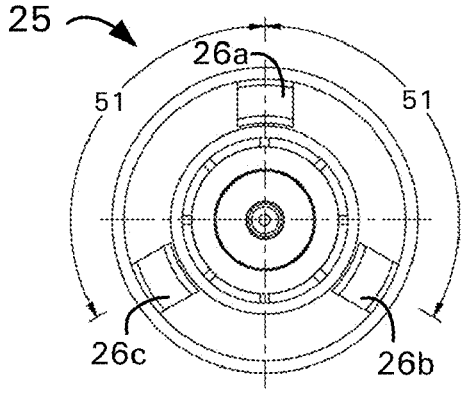
FIG. 8D is a front view of the end plate of the rugged QMA connector plug illustrating tabs oriented at 0°, 120°, and 240° on the face plate according to an embodiment of the present invention.
Figure 8E:
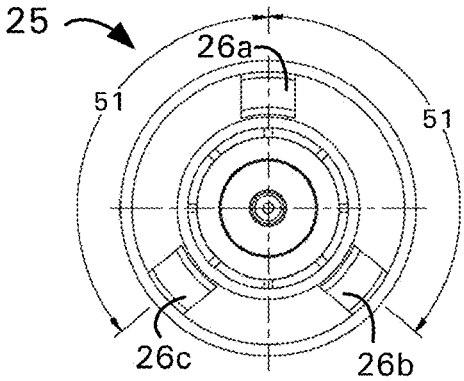
FIG. 8E is a front view of the end plate of the rugged QMA connector plug illustrating tabs oriented at 0°, 130°, and 230° on the face plate according to an embodiment of the present invention.
Figure 8F:
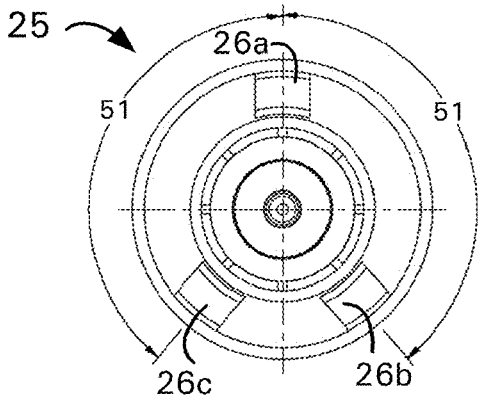
FIG. 8F is a front view of the end plate of the rugged QMA connector plug illustrating tabs oriented at 0°, 140°, and 220° on the face plate according to an embodiment of the present invention.
Figure 9B:
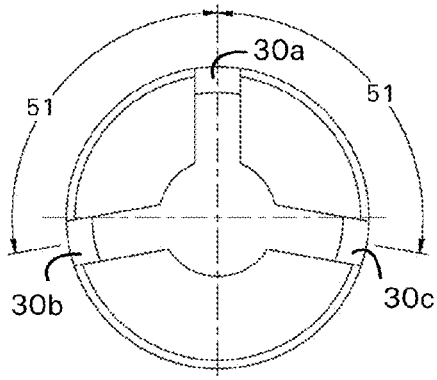
Figure 9C:
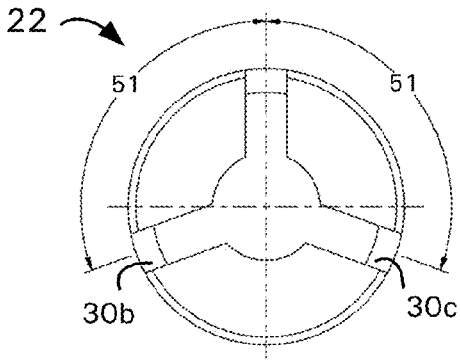
Figure 9D:
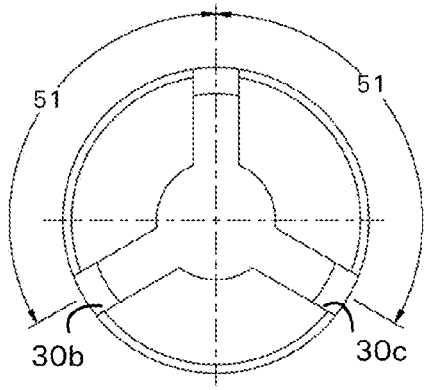
Figure 9E:
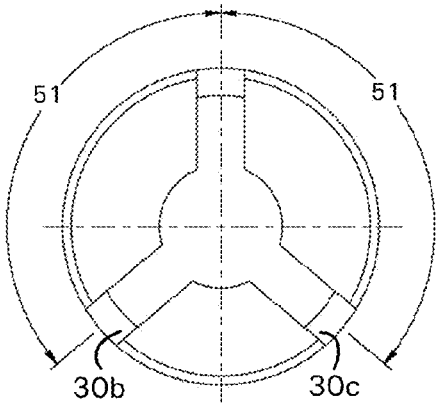
Figure 9F:
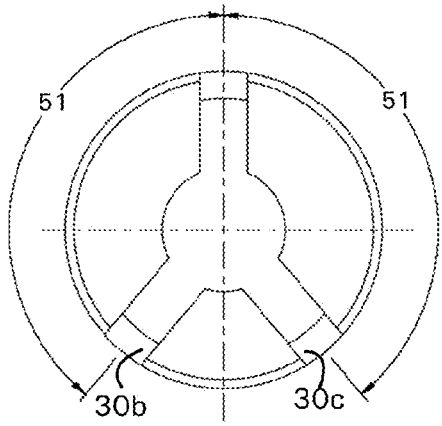
Figure 10:
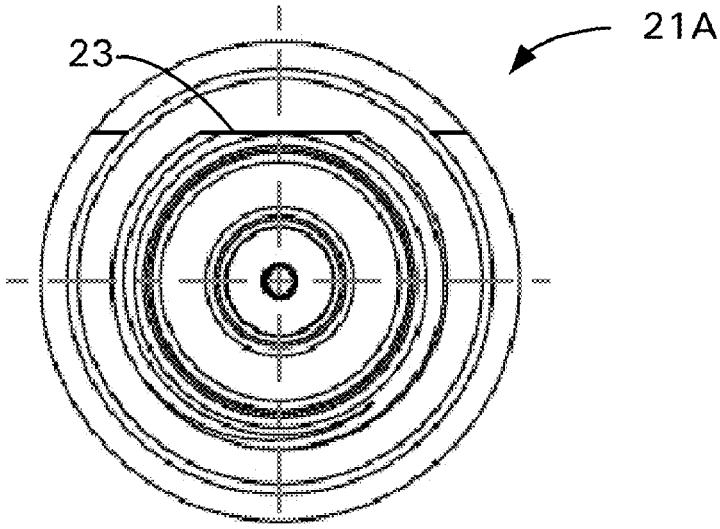
FIG. 10 is a front view of a QMA connector jack without spanner nut as shown in FIG. 3 of the present invention.
Figure 11:
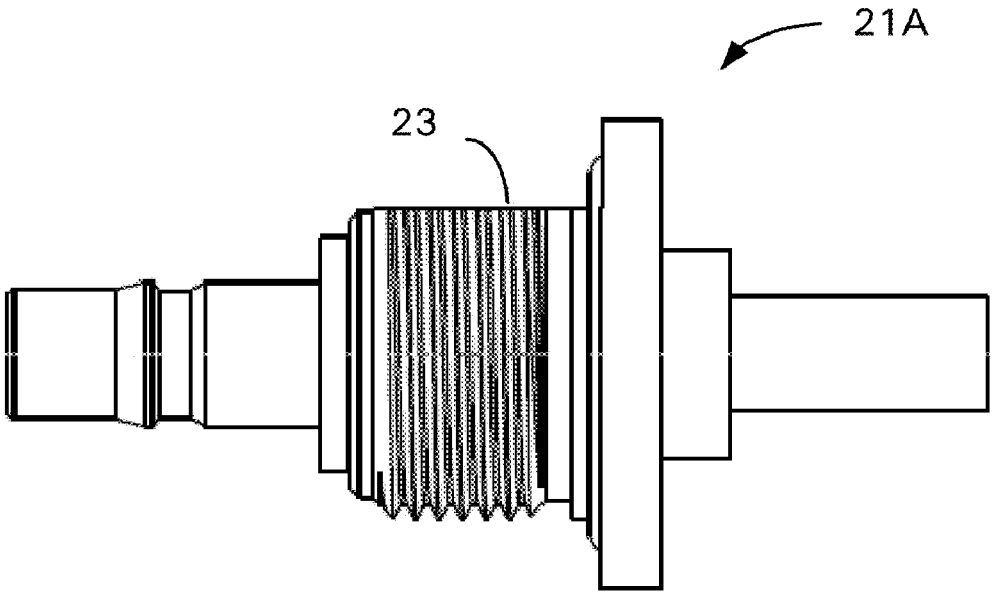
FIG. 11 is a side view of the QMA connector jack of FIG. 10.

In one alternate embodiment shown in FIGS. 10-11, the threaded portion 91 includes a flat portion 23 to aid the use of a tool for mounting the plug 20 in a hole with a mounting surface. In another embodiment, the polarized notches 30 and the polarized tabs 26 are distributed around the periphery of the first end plate 32 and the second end plate 74 at a regular interval 50, 51. The regular interval 50 can be 180° as shown in FIGS. 8A and 9A for a configuration with two polarized tabs and can be selected from a group consisting of a 100°/160°/100° configuration as shown in FIGS. 8B and 9B, a 110°/140°/110° configuration as shown in FIGS. 8C and 9C, a 120°/120°/120° configuration as shown in FIGS. 8D and 9D, a 130°/100°/130° configuration as shown in FIGS. 8E and 9E, and a 140°/80°/140° configuration as shown in FIGS. 8F and 9F shown as 51. While a handful of different configurations is shown, each with square tabs inserted in rectangular notches, what is contemplated is any mated, interfaced configuration between the tabs and notches as defined in the present disclosure.

In an embodiment shown in FIGS. 4 and 7, if the first casing and second casing are made of electrically conductive material such as stainless steel, a seal 27 can be used and placed as shown between the inner threads 91 of the spanner nut 22 in the plug 20. This seal 27 can be made of conductive elastomer to bridge conduction and ground the connector 1. In one alternate embodiment, the spanner nut 22 can be made of a nonconductive material such as high-resistance plastic where internal threads of the spanner nut 22 can be made in a conductive insert glued or pressure locked into place. In another embodiment, the plug interface 31 and the jack interface 77 are QMA jack and plug interfaces.

Connectors 1 include metal housing, plastic housing, elbow socket, bridge socket, threaded latching, watertight, fixed coupler, and vacuum tight models. The contemplated technology is adaptable to all known connector interfaces, including but not limited to the above-listed models and their associated standards. In one embodiment, the plug and the jack are on opposite ends of a fixed coupler such as an adaptor.

One type of SMA connector is made of a male and female interlocking set of 0.312 inch hex nut and fillet. They cover a 0.250×36 thread. The nut is screwed in place by holding the body of the connector and turning the nut using a 5/16 inch wrench. The inner thread defines the male and female counterparts in the SMA connector.

In one embodiment, the female and male contacts are beryllium copper with gold plating, the casings 24, 71 and spanner nut 22 are brass with a nickel plating. The female and male contacts are designed to be mounted on a 0.1 inch mounting surface. In another embodiment, the casings 24, 71 and the spanner nut 22 have an Abaloy plating or a white bronze plating.

In another embodiment, instead of the connector 1 being attached to a first cable 76 or to a second cable 73, an adaptor is made to link between a standard plug and jack. Users connect the adaptor to polarize nonpolarized jacks and plugs. The jack or plug adaptor includes a principal axis 70 for connecting the standard jack or plug to a polarized, rugged plug interface shown in FIG. 7 comprising along the principal axis 70 a standard interface surface to interface with the jack, a first casing 71 with a first end plate 32 having a plurality of polarized tabs 26 along the principal axis 70 for forming the polarized, rugged plug interface 77 to be adapted on the standard jack. In another embodiment, the jack adaptor further includes the second portion of the adaptor, namely, a part with a rugged, polarized plug interface on one end and a standard plug interface on the opposite end on the secondary axis.

The adaptor includes a plug adaptor with a secondary axis 72 for connecting the jack adaptor to the polarized, rugged plug interface along the secondary axis 72 comprising along the secondary axis 72 a standardized interface to interface with a plug, a second casing 24 with a second end plate 74 to interface with the plug having with at least two polarized notches 30, and wherein when the rugged plug interface 31 is mated to the rugged jack interface 77 by interlocking the polarized tabs 32 and the polarized notches 30.

In yet another embodiment, what is contemplated is a method for keying one or more mating connector pairs, the connectors including a first connector 20 with a first end plate 74 with notches 30 in the first end plate 74 distributed along the external radius of the first end plate along a first configuration, and a second connector 25 with a second end plate 32 with tabs 26 in the second end plate 32 distributed along the external radius of the second end plate 32 along the first configuration, the method including the steps of placing the first connector 20 on a first end of a cable 73 to connect, placing the second connector 25 on a second end of a cable 76, and mating the tabs 26 on the first end plate 32 to the notches 30 of the second end plate 32 to connect the first connector 20 to the second connector 25 so the first end of the cable 73 is connected to the second end of the cable 76. In a further embodiment, the first connector 20 includes a threaded portion 91 and a spanner nut 22 with the second end plate 74.

Persons of ordinary skill in the art appreciate that although the teachings of this disclosure have been illustrated in connection with certain embodiments and methods, there is no intent to limit the invention to such embodiments and methods. On the contrary, the intention of this disclosure is to cover all modifications and embodiments falling fairly within the scope the teachings of the disclosure.

What is claimed is:

1. A polarized connector, comprising:

a jack with a principal axis for connecting a first cable to a jack interface, the jack comprising along the principal axis a first cable holder to connect the first cable, a first casing with a first end plate having a plurality of polarized rugged tabs, and the jack interface; and a plug with a secondary axis for connecting a second cable to a plug interface, the plug comprising along the secondary axis a second cable holder to connect the second cable, and a second casing with a second end plate with at least two polarized notches, and the plug interface;

wherein when the plug interface is connected to the jack interface for connecting the first cable to the second cable, the first end plate is adjacent to the second end plate and the at least two polarized rugged tabs are mated without being bent to the polarized notches; and wherein the first end plate has a surface is perpendicular to the principal axis and the plurality of polarized rugged tabs extending from the surface in a direction parallel to the principal axis.

2. The polarized connector of claim 1, wherein the principal axis is a longitudinal axis.

3. The polarized connector of claim 1, wherein the secondary axis is a longitudinal axis.

4. The polarized connector of claim 1, wherein the second casing is a threaded portion on a body portion of the plug and a spanner nut with an inner thread mounted to the threaded portion.

5. The polarized connector of claim 4, wherein the threaded portion includes a flat portion for mounting the plug in a hole in a mounting surface.

6. The polarized connector of claim 1, wherein the plug further includes a holding plate to secure the plug in place.

7. The polarized connector of claim 1, wherein the polarized notches and the polarized tabs are distributed around the periphery of the first end plate and the second end plate at regular intervals.

8. The polarized connector of claim 7, wherein the regular interval is 180° for a configuration with two polarized tabs.

9. The polarized connector of claim 7, wherein the regular interval is a configuration with three polarized tabs, the regular interval is selected from a group consisting of a 100°/160°/100° configuration, a 110°/140°/110° configuration, a 120°/120°/120° configuration, a 130°/100°/130° configuration, and a 140°/80°/140° configuration.

10. The polarized connector of claim 4, further comprising a seal between the inner threads of the spanner nut and the threaded portion on the body.

11. The polarized connector of claim 10, wherein the seal is made of conductive elastomer.

12. The polarized connector of claim 1, wherein the jack interface and the plug interface are respectively a quick-lock RC connector jack-and-plug interface.

13. The polarized connector of claim 1 adapted on a group of connectors consisting of metal housing models, plastic housing models, elbow socket models, bridge socket models, threaded latching models, watertight models, a fixed coupler model, and vacuum tight models.

14. The polarized connector of claim 1, wherein the plug and the jack are on opposite ends of a fixed coupler.

* * * * *